United States Patent [19]

Murao

[11] 4,370,781

[45] Feb. 1, 1983

[54] CLEARER DEVICE PROVIDED ABOVE DRAFT ROLLS

[76] Inventor: Yoshio Murao, No. 6-8, 3-chome, Masuizumi, Kanazawa-shi, Japan

[21] Appl. No.: 212,128

[22] Filed: Dec. 2, 1980

[30] Foreign Application Priority Data

Dec. 3, 1979 [JP] Japan ..... 54/167811[U]

[51] Int. Cl.[3] ..... D01H 5/62

[52] U.S. Cl. ..... 19/245; 19/262; 19/265

[58] Field of Search ..... 19/236, 244, 245, 266, 19/262, 265

[56] References Cited

U.S. PATENT DOCUMENTS

| | | | |
|---|---|---|---|
| 2,328,324 | 1/1956 | Burman | 19/261 |
| 2,593,478 | 4/1952 | Newton | 19/262 X |
| 2,648,875 | 8/1953 | Gibson | 19/265 X |
| 2,735,142 | 2/1956 | Noiles | 19/265 X |
| 2,951,268 | 9/1960 | West | 19/262 X |
| 3,086,255 | 4/1963 | Cordis | 19/265 |
| 3,838,476 | 10/1974 | Gort | 19/265 X |
| 3,902,225 | 2/1976 | Murao | 19/265 |

FOREIGN PATENT DOCUMENTS

| | | |
|---|---|---|
| 1255100 | 1/1961 | France . |
| 575481 | 5/1976 | Switzerland . |
| 324530 | 1/1930 | United Kingdom . |
| 784031 | 10/1957 | United Kingdom . |

*Primary Examiner*—Louis Rimrodt

*Attorney, Agent, or Firm*—Oblon, Fisher, Spivak, McClelland & Maier

[57] ABSTRACT

There is provided a clearer device located above a series of draft rolls with a predetermined number of plumbs and secured inside a cover plate rotatable and removable by means of a pivot formed in part of two side plates. This clearer device is characterized in that endless clearer members stretch between intermittently driven clearer rolls and guide members permitting said clearer members to abut front top rolls fixedly secured. A pressure member is springingly held back of said clearer members to force downward said clearer members and permit said top rolls or a top apron to come into contact with said clearer members. The clearer rolls are intermittently driven by swinging a rocking lever pivoted on the shafts of said clearer rolls via an oscillation lever and rotating a ratchet gear fixed on said roll shafts by means of engaging tooth at said rocking lever. A comb is located above the course of movement of said clearer members to face against said clearer members and is secured on the bottom of an "L" shaped lateral bar the central portion of which is held on a support member with an adjustable inclination.

3 Claims, 8 Drawing Figures

CLEARER DEVICE PROVIDED ABOVE DRAFT ROLLS

BACKGROUND OF THE INVENTION

1. Field of the Invention:

This device relates to a clearer device provided above a drawing frame of a spinning machine, and more particularly to a clearer device which holds and rotates endless clearer members in contact with draft rolls and automatically wipes off lint and fly carried by the clearer members.

2. Description of the Prior Art:

It is generally known that a clearer device may be provided for rolls within a drawing frame of a spinning machine since the fly adheres easily to the rolls and fibers become wrapped around the rolls while being spinned. The conventional clearer device comprises clearer members of a proper material from which fly or dust may be easily wiped off, the clearer members being held in contact with the surfaces of respective draft rolls. Those clearer members are of either the stationary type which remains in contact with the draft rolls or the rotary type which moves actively. The former is simple in structure and easy to manipulate but troublesome because of the need to repeatedly remove the fluff or dust accumulated thereon (hereinafter called "fuzz"). Since the latter on the other hand is free from such trouble, it has become more and more prevalent. However, many approaches have been proposed in an attempt to avoid the problems of the rotary type, such as that it is complicated in structure, often fails to perform a cleaning operation or wipe off the fly and that the rotation of the clearer members can become unstable and rough. Although those approaches are partially satisfactory, the advantages thereof are questionable as a whole within the clearer device. For the rotary type of clearer devices, there are the requirements that the entire configuration thereof be compact, the clearer members rotate steadily in contact with a series of the draft rolls and removal of the fly accumulated thereon be easy and certain and responsible to the degree of abrasion of the clearer members.

SUMMARY OF THE INVENTION

With the foregoing in mind, it is an object of the present device to provide an improvement in a clearer device which enables compact implementation and fulfills all the requirements discussed above. More particularly, the entire clearer device is installed inside a roll cover which is disposed above a family of draft rolls. A guide member is adapted on the side of front rolls extending and supporting clearer members such that the clearer members can comply with the front top rolls and springingly contact other top rolls or an apron. A device for wiping off the fly is adjustable in degree of wiping.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
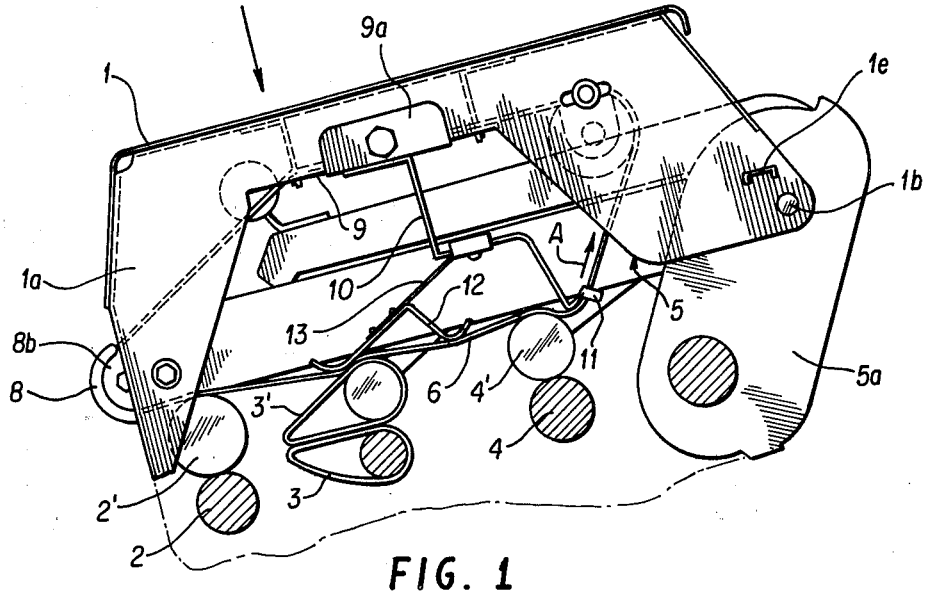
FIG. 1 is a side view of the present clearer device placed above draft rolls of a drawing frame.

Referring now to the drawings, a predetermined number of roll covers are mounted to cover a series of draft rolls within a drawing frame, with each cover corresponding to a staff of the rolls with between four and eight plumbs (in the shown example, four plumbs). Side walls 1*a* (one of which is omitted in the drawings) stand on both sides of the roll cover 1 and a pivot 1*b* is provided behind the side walls 1*a* and secured on a shaft resting on a roll stand, etc. The front side of the covers is held in a position to contact part of the roll stand and is brought into a standby position by hoisting and rotating the covers 1 until they strike a projection 1*e*, when it is desired to move the covers away from the family of the rolls. The present clearer device is provided inside the roll cover 1 such that it can be removed from the rolls together with the cover 1. Whereas the present clearer device is applicable to any arrangement of the rolls within the drawing frame, it is shown as relating to a pair of front rolls 2 and 2', a pair of apron extensions 3 and 3' and a pair of back rolls 4 and 4'. Each of the clearers is provided for a combination of the front top roll 2', the top apron 3' and the back top roll 4'. The present clearer device is also applicable to a roll loading mechanism wherein these top rolls are loosely secured on a pendulum arm 5 by means of a pivot 5*a*.

Clearer members 6 are of a conventional material of an endless form such as fluffy cloth, felt and nonwoven fiber and stretch across the roll cover. Specifically, the clearer members extend between a clearer roll 7 affixed to a rotary shaft 7*a* and a guide member 8 affixed to a stationary shaft 8*a*. Inside the side walls 1*a* there are secured the rotary shaft 7*a* of the clearer roll 7 and the stationary shaft 8*a* of the guide member 8 via brackets 7*b* and 8*b*. The rotary shaft 7*a* is rotatable and the stationary shaft 8*a* is fixed. It is recommended that the stationary shaft 8*a* take the shape of a rectangular bar. The clearer roll 7 with its peripheral surface covered with an abrasive member such as a rugged rubber sheet or having slits formed directly therein help the clearer members 6 move and rotate. The guide member 8 smooths the movement of the clearer members and may be a molded resin member as depicted in the drawings. The guide member 8 used herein has a horn-shaped section 8*c* opposite the direction of travel of the clearer members 6 and a curved section 8*d* adjacent the tip thereof. The curved section 8*d* is located in face-to-face relationship with the surfaces of the front top rolls 2' and the clearer members 6 extend across the curved section into contact with the rolls by use of the horn-shaped section. For guiding the clearer members 6, guide walls are built on the side of the guide member 8 where the clearer members enter and on both sides of the curved section 8*d* and are secured in place on the stationary shaft 8*a* by means of stud bolts (not shown).

Conversely, on the opposite side of the clearer members 6, which faces against the draft rolls, there are disposed a clearer guide members 11 and a pressure member 12 two of which rest on a mount 9 positioned to cover openings at the lowest portions of middle walls 1*d*. An arm plate 10 is secured on the bottom of the mount 9 to correspond to the respective clearer members 6, which arm plate is of an "L" shaped profile and has the guide member 11 at its lowest end integral therewith or separate therefrom. The pressure member 12 is secured above the arm plate 10 via a spring plate 13. Under the circumstance where the clearer device is located in face-to-face relationship with the draft rolls, the guide member 11 and the pressure member 12 force the clearer members into contact with the respective top rolls and top aprons (See FIG. 1). The clearer members, on the other hand, must actively travel in one direction and wipe off the fly carried by the rolls while the surfaces thereof being constantly cleared are in contact with the rolls. To this end there is provided a device for driving the rotary shaft 7*a* for the clearer rolls 7 and a device for wiping or stripping the fly carried by the clearer members. Within the present clearer device, these devices are driven by a common drive means. The clearer members 6 are intermittently driven and the clearer members 6 and the wiper device are alternatively and smoothly driven. The wiper device is easily adjustable. More particularly, the rotary shaft 7*a* for the clearer rolls 7 is driven by the engaging relationship between a finger 27 attached to a swing bracket 25 rotatable about the center of the rotary shaft 7*a* and a ratchet gear 26 located within the swing bracket 25 and fixed on the rotary shaft 7*a*. The swinging movement of the swing bracket 25 allows the finger 27 to rotate the ratchet gear 25. In the drawings two of the fingers 27 are employed with a difference in engaging position therebetween. Force is transmitted from an oscillator device including a rotary cam (not shown), for example, to the swing bracket 25 via an actuator rod 30. Since the present clearer device is removable from the family of the draft rolls, it is preferable that the actuator rod 30 be always in an operative position even when shifting the clearer device. The actuator rod 30 is therefore loaded with a spring 29*a* which is not normally compressed. A link rod 29 is of a cylindrical form receiving the actuator rod 30 which has a head 30*a* resting on the tip thereof. The coil spring 29*a* is inserted between the head 30*a* and the bottom of the cylindrical link rod 29. The head of the cylindrical link rod 29 is provided on a shaft 28 passing through the swing bracket 25, while the counterpart 30*a* of the actuator rod 30 abuts against the shaft 28. When the clearer device is moved away together with the roll cover 1, the coil spring 29*a* is compressed and the link rod 29 is held in the operative position without obstructing the clearer device.

Figure 2:
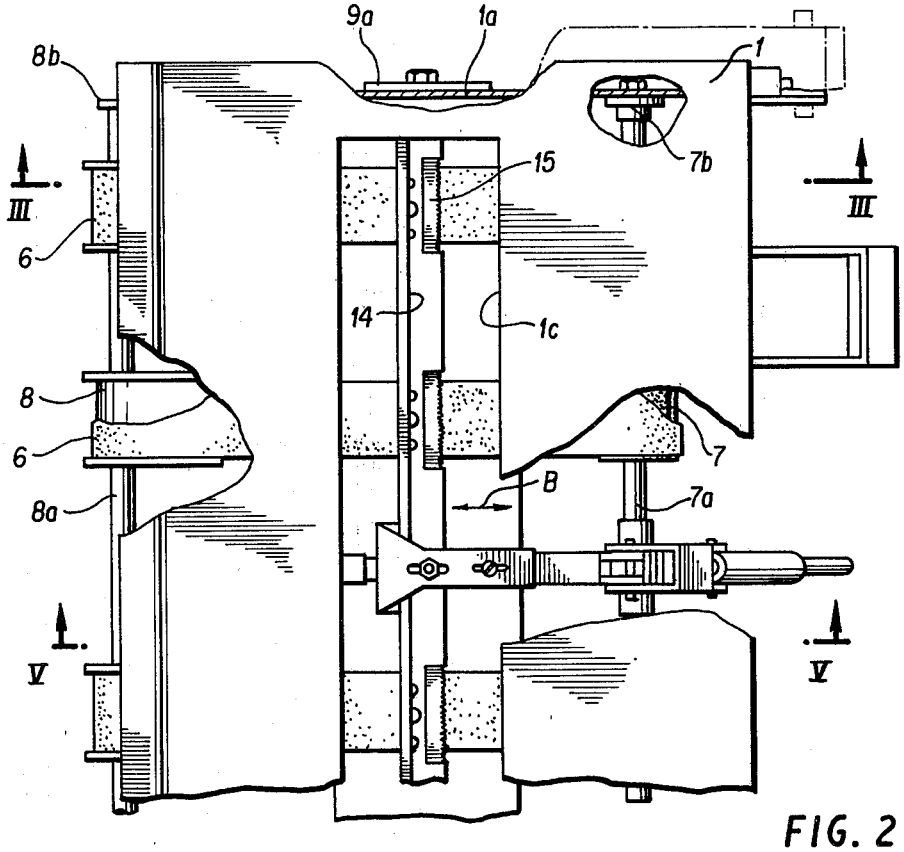
FIG. 2 is a fragmentary plan view of the device taken along the arrow direction of FIG. 1.
Figure 3:
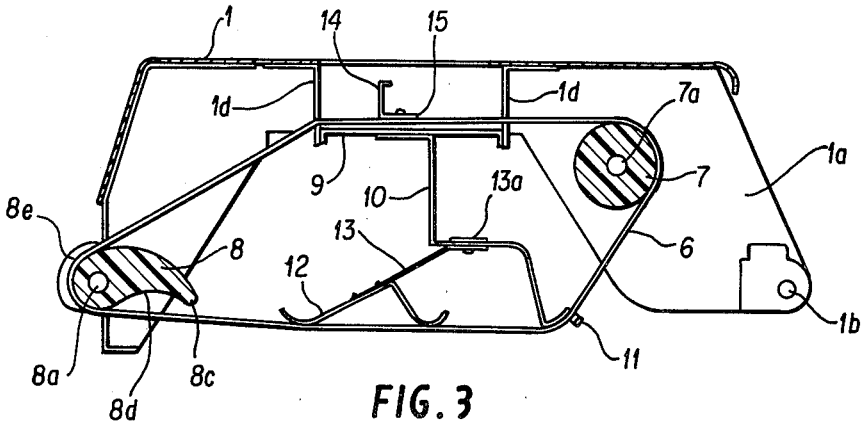
FIG. 3 is a cross-sectional view taken along the line III—III of FIG. 2.
Figure 4:
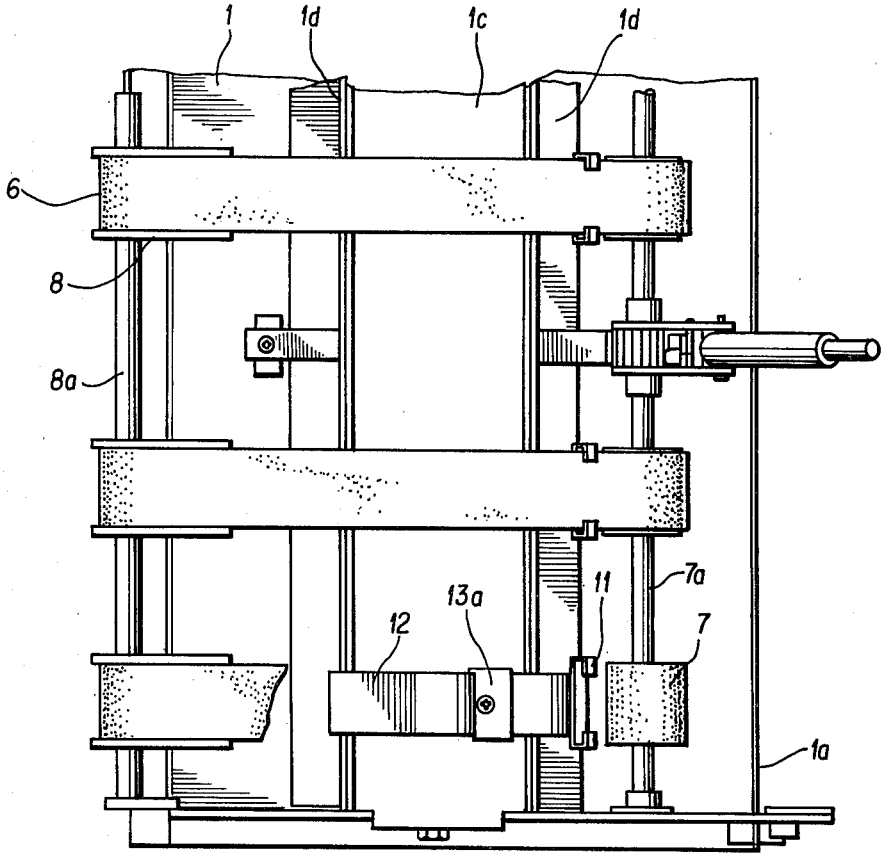
FIG. 4 is a bottom view of FIG. 3.
Figure 5:
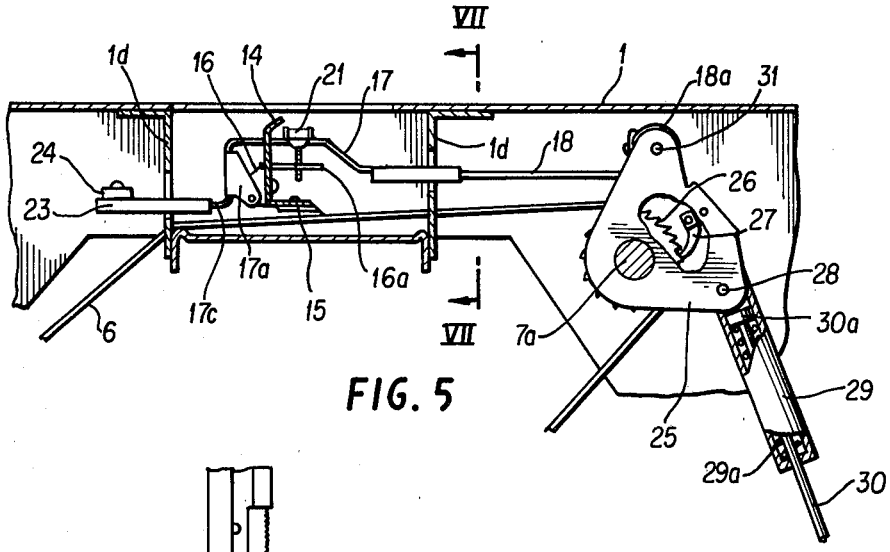
FIG. 5 is a cross-sectional view taken along the line V—V of FIG. 2.
Figure 6:
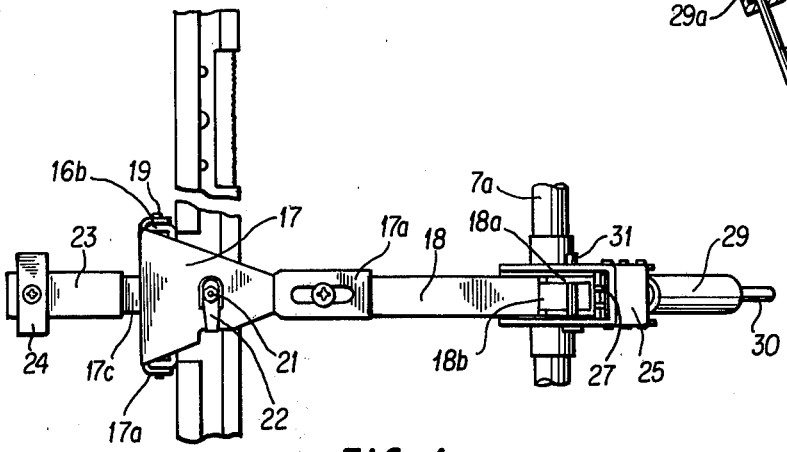
FIG. 6 is a plan view of a combing device only.
Figure 7:
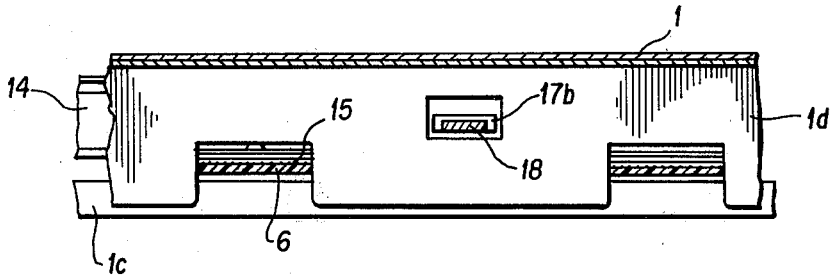
FIG. 7 is a cross-sectional view taken along the line VII—VII of FIG. 5.
Figure 8:
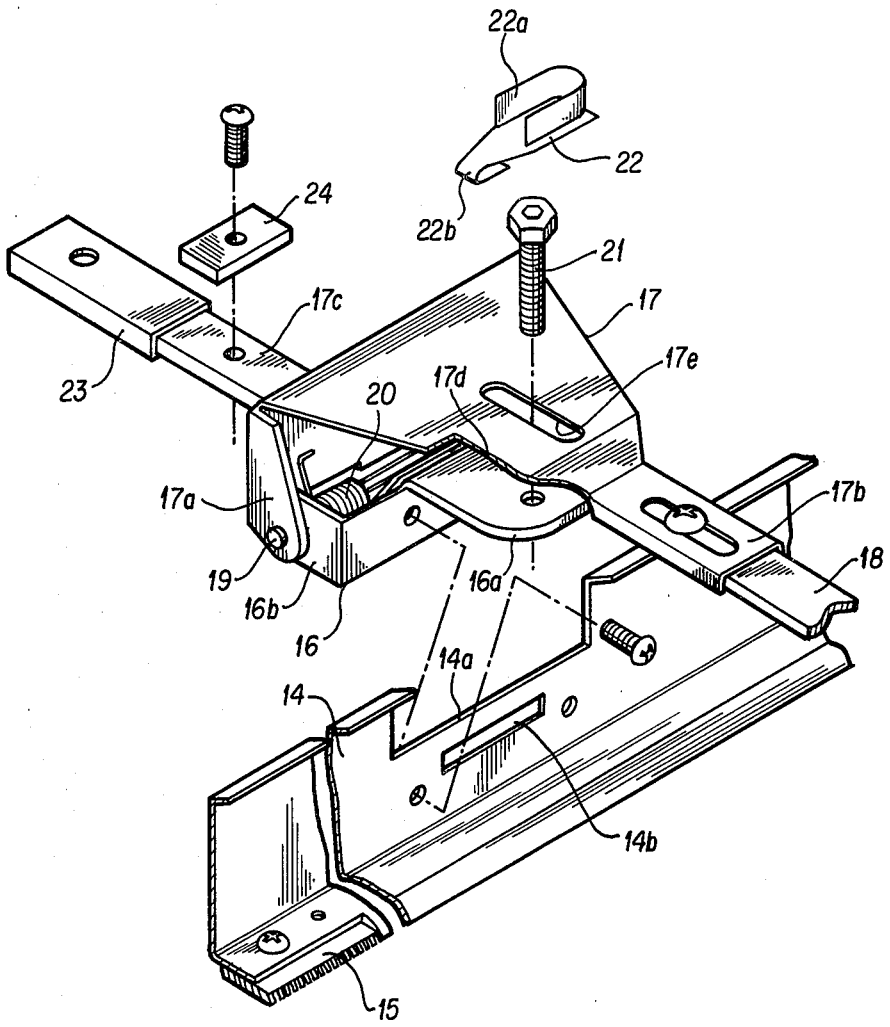
FIG. 8 is an exploded perspective view of part of FIG. 6.

The wiper device for the clearer members comprises combs 15 traversing along the direction of travel of the clearer members 6 and secured on comb bars 14 which in turn are located between the middle walls 1*d* on the bottom of the roll cover 1. The comb bars lightly rest on the upper surfaces of the clearer members 6. The top of the roll cover 1 is windowed as indicated at 1*c*. The comb bars 14 are coupled to the swing bracket 25 and mounted on a support member traversing in the arrow direction B (See FIG. 2) such that an inclination of the comb bars 14 is adjustable. As shown in FIG. 8, the support member 17 has two side walls 17*a* at its front wall section. A comb bar supporting bracket 16 has a rear wall serving to support the comb bar 14 and side walls 16*b*. The side walls 16*b* are located inside the side walls 17*a*, allowing passage of a shaft 19 loaded with a spring 20 therethrough. The spring 20 exerts force on the upper sections of the support member 17 and the comb bar supporting bracket 16 to separate them from each other. The comb bracket 16 also has an integral tongue 16*a* at its mid upper portion on the rear wall. The comb bar 14, on the other hand, has a cutout 14*a* and a hole 14*b* below the cutout 14*a* for receiving the tongue 16*a*. When the comb bar 14 is supported, the tongue 16*a* protrudes behind the comb bar 14 through the hole 14*b*. The support member 17 is provided with a play 17*e* in which an adjustment screw 21 is fitted. The adjustment screw 21 is screwed into a screw hole in the tongue 16*a*. A stop 22 of an elastic steel material prevents the adjustment bolt 21 from freely rotating while the head of the adjustment bolt 21 is sandwiched between the opposite sides 22*a* thereof. A folded section 22*b* at one end of the stop 22 is fitted into a step section 17*d* of the support member 17 to prevent rotation of the support member. Since the support member 17 and the comb bar 14 are biased with the spring 20 such that the comb 15 on the bar 14 faces against the clearer members 6 at an obtuse angle, the adjustment bolt 21 fastens tightly the support member 17 and the tongue 16*a* against the spring 20. The comb 15 can incline upwardly or downwardly via the tongue 16*a* upon fastening or unfastening the bolt 21. This is accomplished against force developed between the side walls 22 of the stop 22. The stop may be replaced by other engaging structures.

The above discussed support member 17 has a connection section 17*b* on the rear side thereof and a support rod 17*c* on the front side thereof both of which are integral with the support member. The connection section 17*b* is coupled to a link rod 18 pivoted on the swing bracket 25. Since the support rod 17 is held on one of the middle walls 1*d* attached to the roll cover 1, it is recommended that a sheath 23 of wearproof resin material be provided to receive the support rod 17*c*. A stop 24 prevents the support rod 17*c* from moving out of a hole in the middle wall 1*d*. The link rod 18 is held in engaging relationship with the swing bracket 25 through an engaging section 18*a* of the former and a shaft 31 on an upper section of the latter and is detachable against the force of a plate spring 18*b*. This is useful in assembling and disassembling the device but other means are also applicable for this purpose.

The clearer device discussed above allows the clearer members to firmly contact the rolls and provides stable clearing operation. In addition, the clearer device may be efficiently accommodated within the roll cover and is easy to manipulate and maintain. The wiper device for removing the fly from the clearer members is also adjustable in inclination with respect to the clearer so that the surface of the clearer members in contact with the draft rolls is always held clean.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A clearer device of a plurality of draft rolls, including top rolls, within a drawing frame, comprising:

cover means having one end pivotally secured to said drawing frame and having side plates;

at least one guide member associated with said cover;

at least one rotatable clearer roll associated with said cover;

at least one endless clearer member extending around said at least one guide member and said at least one clearer roll, said at least one clearer member being positioned so as to contact said top draft rolls when said cover is pivoted in a first closed position;

at least one pressure member resiliently associated with said cover and adapted to pressure said at least one endless clearer member into contact with said top draft rolls;

means for intermittently driving said at least one rotatable clearer roll; and comb means associated with said cover, said comb means being positioned in angularly adjustable contact with said at least one clearer member, wherein said comb is in contact with the top course of said at least one clearer member and said comb is secured to the bottom of an L-shaped lateral bar, the central portion of which is adjustably held on a support member; and wherein said guide members each include beak portions having curved lower surfaces cooperable with one of said top rolls, and further include lateral guide walls, whereby said endless clearer member is guided between said one top roll and said guide member.

2. The clearer device of claim 1 wherein said means for intermittently driving comprises:

a ratchet gear fixed on the shaft of said at least one rotatable cleaner roll;

a rocking lever pivoted on said cover and including a pawl engageable with said ratchet gear; and an oscillation lever pivoted to said rocking lever for oscillating said rocking lever.

3. The clearer device of claim 1, wherein said at least one clearer member contacts a top apron of said top draft rolls.

* * * * *